US009259780B2

(12) United States Patent
Waitlevertch et al.

(10) Patent No.: US 9,259,780 B2
(45) Date of Patent: Feb. 16, 2016

(54) ROTATIONAL LANCE DRIVE AND ROTATIONAL LANCE INJECTION METHOD

(71) Applicant: ESM Group Inc., Amherst, NY (US)

(72) Inventors: Joseph R. Waitlevertch, Butler, PA (US); Larry J. Epps, Butler, PA (US); Nicholas S. Romeo, Butler, PA (US)

(73) Assignee: ESM Group Inc., Amherst, NY (US)

( * ) Notice: Subject to any disclaimer, the term of this patent is extended or adjusted under 35 U.S.C. 154(b) by 391 days.

(21) Appl. No.: 13/833,913

(22) Filed: Mar. 15, 2013

(65) Prior Publication Data

US 2014/0263703 A1 Sep. 18, 2014

(51) Int. Cl.

| | |
|---|---|
| ***C21C 5/32*** | (2006.01) |
| ***B22D 1/00*** | (2006.01) |
| ***B01F 3/04*** | (2006.01) |
| ***C22B 9/05*** | (2006.01) |
| ***C22B 9/10*** | (2006.01) |
| ***B01F 7/00*** | (2006.01) |
| ***B01F 11/00*** | (2006.01) |
| ***B01F 3/12*** | (2006.01) |
| ***B01F 3/14*** | (2006.01) |
| ***C21C 5/46*** | (2006.01) |
| ***F27D 3/16*** | (2006.01) |
| ***F27D 3/18*** | (2006.01) |

(52) U.S. Cl.

CPC ..... *B22D 1/005* (2013.01); *B01F 3/04539* (2013.01); *B01F 3/1221* (2013.01); *B01F 3/14* (2013.01); *B01F 7/001* (2013.01); *B01F 7/005* (2013.01); *B01F 7/007* (2013.01); *B01F 11/0088* (2013.01); *C21C 5/462* (2013.01); *C22B 9/05* (2013.01); *C22B 9/103* (2013.01); *F27D 3/16* (2013.01); *F27D 3/18* (2013.01); *B01F 2003/04546* (2013.01); *B01F 2003/125* (2013.01); *C21C 5/4613* (2013.01); *Y10T 74/18056* (2015.01); *Y10T 74/18096* (2015.01)

(58) Field of Classification Search

CPC .... C21C 5/4606; C21C 5/462; C21C 5/4633; C21C 5/464; C21C 5/4613; F27D 3/16; B01F 11/0088; B01F 2003/04546; B01F 2003/125; B01F 3/04539; B01F 3/1221; B01F 3/14; B01F 7/001; B01F 7/005; B01F 7/007; B22D 1/005; C22B 9/05

USPC ..... 266/225, 226, 217

See application file for complete search history.

(56) References Cited

U.S. PATENT DOCUMENTS

| | | | | | |
|---|---|---|---|---|---|
| 3,701,518 | A | * | 10/1972 | Herff | 266/86 |
| 4,097,031 | A | * | 6/1978 | Higuchi et al. | 266/226 |
| 4,426,068 | A | | 1/1984 | Gimond et al. | |
| 4,931,091 | A | | 6/1990 | Waite et al. | |
| 5,037,069 | A | * | 8/1991 | Stomp et al. | 266/226 |
| 5,188,661 | A | | 2/1993 | Cook et al. | |
| 6,010,658 | A | | 1/2000 | Ross et al. | |
| 7,563,405 | B2 | | 7/2009 | De Castro | |

* cited by examiner

*Primary Examiner* — Scott Kastler
*Assistant Examiner* — Michael Aboagye
(74) *Attorney, Agent, or Firm* — Hodgson Russ LLP

(57) ABSTRACT

Rotary lance drives for rotating a lance for injecting gas and powdered reagents into molten metal include a reciprocating rotary lance drive and an associated method. A lance mount which facilitates loading of a lance into a lance drive is also disclosed. Various lance designs are described for improving dispersion of reagent and decreasing process time, including lances having non-circular refractory portions and lances having cross-port arrangements for more evenly distributed reagent discharge.

2 Claims, 19 Drawing Sheets

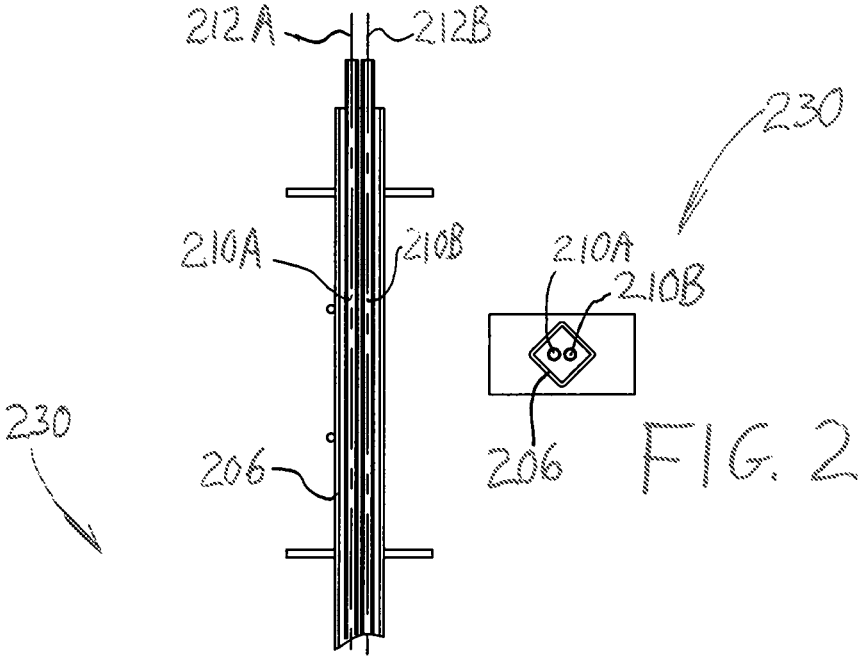
FIG. 28
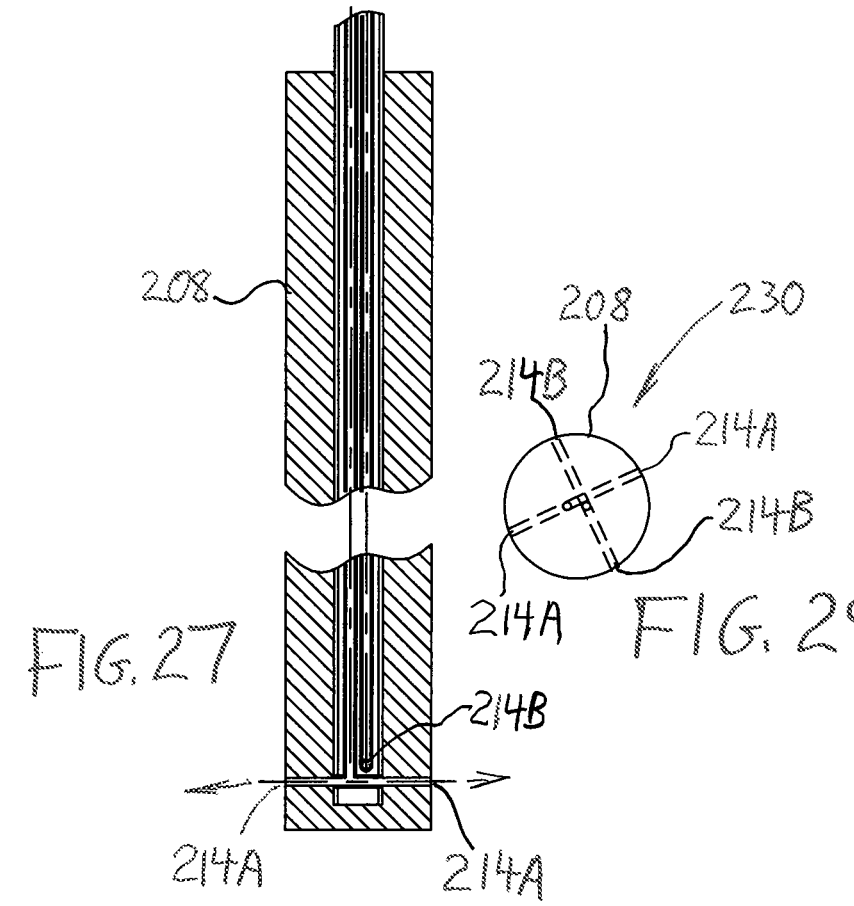
FIG. 27
FIG. 29

ROTATIONAL LANCE DRIVE AND ROTATIONAL LANCE INJECTION METHOD

FIELD OF THE INVENTION

The present invention relates generally to treatment of molten metal by injection of reagents or gas into the molten metal through an injection lance, and more particularly to lance drives and lances for performing such treatment. An example of a type of treatment is the desulfurization of molten iron.

BACKGROUND OF THE INVENTION

The typical lance drive comprises a rigid lance mount to which the lance connects. The lance mount may take a variety of forms, but must allow for used lances to be removed from the lance drive and for new lances to be mounted on the drive. In a known lance mount configuration, a swing-gate design is used to clamp the lance into the lance mount of the lance drive. This swing-gate consists of a thick steel bar sandwiched between two other steel bars. A pivot pin will be run through all three bars and will allow the middle bar to swing open like a gate. Once the lance is mounted to the lance and the gate is closed, a threaded rod with wing nut will anchor it firmly on the lance drive. Typically, the top of the lance will include a structural steel member, which can be round or square, to which the lance can be attached to the lance drive.

At the top of the lance is a connection to which reagent or gas transport piping or hose will connect. This connection could be threaded, flanged, or attached using other means. To allow movement of the lance, the top connection will typically be made with flexible hose. Once the lance is connected to the transport pipe or transport hose and the lance is firmly in the lance mount on the lance drive, the lance can be driven by the lance drive into the molten bath for treatment of iron or steel. Other than a vertical movement into the molten metal, the typical lance drive provides has no other range of motion to the lance. This "fixed" lance drive may be used with a bottom blow lance, a Tee lance, or a dual port lance.

To improve efficiency and reduce process time, rotary lance drives were developed that rotate the lance in addition to providing vertical movement. Rotary lance drives are described in U.S. Pat. No. 4,426,068 (Gimond et al.) and U.S. Pat. No. 7,563,405 (De Castro). Rotary motion distributes the powdered reagents to a larger reaction zone in the bath compared to fixed lance treatment. Known rotary lance systems use a Tee lance having two outlets, and the lance is rotated continuously through 360 degree circles.

Existing rotary lance drives, including a lance drive made by applicant, include a swivel connection at the top of the lance drive to allow for rotation of the lance without twisting the reagent supply hose feeding into the transport pipe or transport hose of the lance drive. In applicant's existing rotary lance drive design, shown in FIGS. 1-4, a swivel connection 2 is connected to a reagent transport pipe 4 which extends through the rotary lance drive mechanism to a connection 6 at the top of the lance 8. To rotate the lance, the existing rotary lance drive uses a motor 10 which rotates a hollow drive shaft 12 connected to the motor by a gear drive 14. The hollow shaft 12 is necessary to allow passage of the reagent transport pipe 4 from the swivel connection 2 to the connection 6 at the top of the lance 8. The hollow drive shaft 12 is supported by two rotary bearings 16 which are spaced sufficiently to take the radial and axial loads. The gear drive 14 is connected to an upper portion of the hollow drive shaft 12. A lower end of the hollow drive shaft 12 is rigidly connected to a lance mount 18 that clamps the lance 8 in place. In the existing rotary lance drive, the two rotary support bearings 16 are internal and require the entire drive mechanism to be disassembled for periodic maintenance or replacement. Another drawback is that the reagent transport pipe 4 has two connections (swivel connection 2 and lance connection 6) that are a source of leaks and require maintenance.

Regarding injection lances carried by lance drives, the most common lance design is the bottom-blow lance. In its center is a steel pipe through which gas and powdered reagents are transported into molten iron or molten steel. Typically, the top will include a structural steel member, which can be round or square, by which the lance can be attached to the lance drive. To protect the transport pipe from the molten metal, a lower portion of the lance will coated with a refractory material which insulates the pipe from the intense heat. The refractory portion has a circular cross-sectional shape. A variation of the basic bottom-blow lance is the Tee lance, which is less common than the bottom-blow lance but nevertheless is currently being used. The Tee lance has two separate discharge ports facing discharge directions which are 180 opposite one another. The two ports discharge ports are fed by a single main pipe conduit with a Tee at the bottom. As with the bottom-blow lance, the Tee lance includes a steel pipe defining the main conduit, a structural steel top, and a refractory bottom. The benefit of this design is that the powdered reagent is split into two zones instead of one. The standard Tee lance is currently the preferred design for rotary lance drives.

A dual port lance is known from U.S. Pat. No. 5,188,661. The dual port lance includes two independent pipes through which two streams of powder reagent or gas can pass. This allows twice as much material to feed into the molten bath, thereby reducing the time needed to treat the metal. This offers a great advantage in minimizing treatment time which allows for more production by a steel mill.

SUMMARY OF THE INVENTION

The present invention provides improved rotary lance drives and methods that address the problems mentioned above. The present invention further provides a lance mount that allows for simple and secure loading of a lance in a lance drive. Finally, the present invention provides novel lances for use in a rotary lance drive that are configured to further improve efficiency and reduce process time.

A rotary lance drive according to a first embodiment of the present invention comprises a main support having a support housing and a pair of rotary bearings arranged external to the support housing respectively adjacent an upper end and a lower end of the support housing. A hollow drive shaft extends vertically through the support housing and is supported by the rotary bearings for rotation about a vertical axis. A drive motor is connected to the hollow shaft at a location above the upper end of the support housing, and is operable to rotate the hollow drive shaft about the vertical axis. A lance mount is rigidly connected to the hollow drive shaft for rotation with the hollow drive shaft and is configured to permit an injection lance to be removably held by the lance mount for rotation with the lance mount. The lance drive further comprises a transport pipe extending vertically through the hollow drive shaft and into the lance mount, wherein a bottom end of the transport pipe is connectable to a lance held by the lance mount. A swivel coupling receives a top end of the transport pipe and permits connection of a flexible reagent supply hose to the transport pipe so as to allow relative rotation between the transport pipe and the supply hose.

A reciprocating rotary lance drive is provided in a second embodiment of the present invention. The reciprocating rotary lance drive comprises a rotary element rotatable about a rotational axis and configured for connection to an upper portion of a lance such that rotation of the rotary element is imparted to the lance. A linear actuator having a stroke axis and a stroke length is connected to the rotary element by at least one transmission element displaced by the linear actuator. The transmission element is connected to the rotary element such that linear motion of the linear actuator is converted to rotational motion of the rotary element about the rotational axis. The rotary element may be embodiment as a pinion gear and the at least one transmission element may be a rack mated with the pinion. Successive extension and retraction of the linear actuator along the stroke axis causes reciprocating rotational motion of the lance in opposite rotational directions. The stroke length is chosen such that the linear actuator causes a rotation of the lance that is less than 360 degrees in a given rotational directions. The reciprocating lance drive provides for a mechanically simplified rotary lance drive. The invention also encompasses a method of injection using reciprocating rotary motion of an injection lance.

A lance mount usable with a lance drive, such as the rotary lance drive of the first embodiment, includes a support sleeve fixable to the lance drive and having an open front and an open bottom. At least one gate member is pivotally connected to the support sleeve for movement between an open position in which the gate member does not block the open front and a closed position in which the gate member blocks the open front, and at least one locking mechanism is provided to releasably secure a corresponding gate member in the closed position. The lance mount further includes a pair of laterally spaced angle members pivotally connected to the support sleeve for rotation about a transverse pivot axis, each of the pair of angle members having a support leg through which the pivot axis extends, a lever leg extending from the support leg, and a loading slot formed in the angle member at a location spaced from the pivot axis. Each of the pair of angle members is rotatable about the pivot axis between a loading position and a locking position. The respective loading slots of the angle members are aligned along a transverse slot axis and are configured to receive opposite end portions of a cross-member of the injection lance. The slot axis is forward from the open front of the support sleeve when the pair of angle members are in the loading position, and the slot axis passes through the support sleeve when the pair of angle members are in the locking position. The lance mount allows the cross-member of the lance to be placed into the loading slot while the slot is outside the support sleeve and is easily accessible, and then moved into the support sleeve by pivoting the angle members.

The present invention also encompasses various lance designs intended for use with the a rotary lance drive, such as the rotary lance drive and the reciprocating rotary lance drive summarized above. The lance designs may be characterized by a lower refractory portion having non-circular cross-sectional shape for stirring and agitating the molten metal when the lance is rotated. The lance designs may alternatively or additionally be characterized by a crossing arrangement of discharge ports.

BRIEF DESCRIPTION OF THE DRAWING VIEWS

The invention will be described in detail below with reference to the accompanying drawing figures, in which:

FIG. 27 is a sectional view of a cross dual-port lance formed in accordance with a further embodiment of the present invention;

FIG. 28 is a top view of the lance shown in FIG. 27; and

FIG. 29 is a bottom view of the lance shown in FIG. 27.

DETAILED DESCRIPTION OF THE INVENTION

Figure 1:
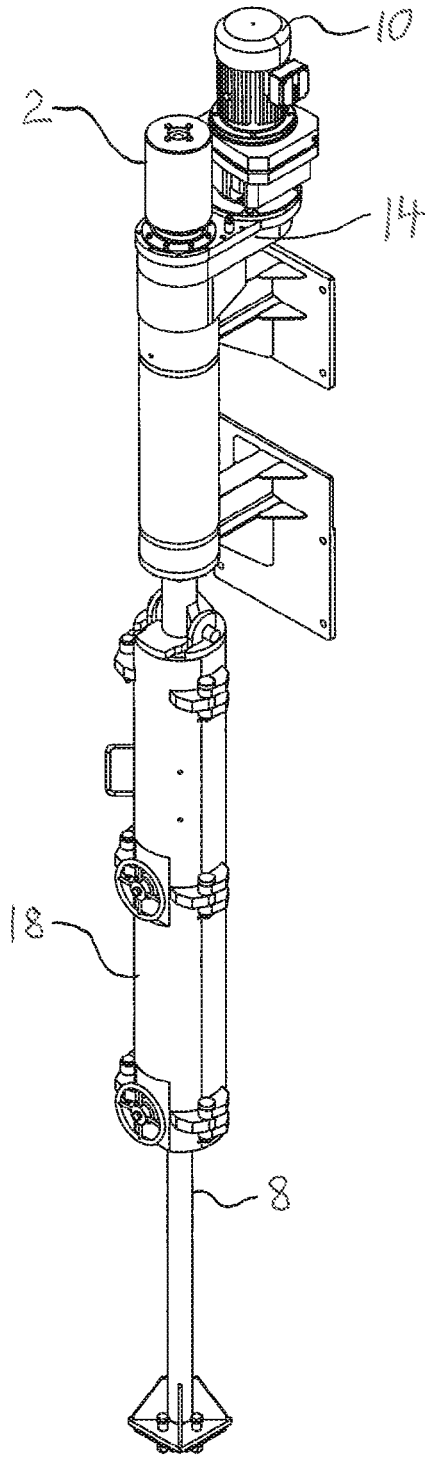
FIG. 1 PRIOR ART
FIG. 1 is a perspective view of an existing rotary lance drive made by applicant, shown holding an upper portion of a lance.
Figure 2:
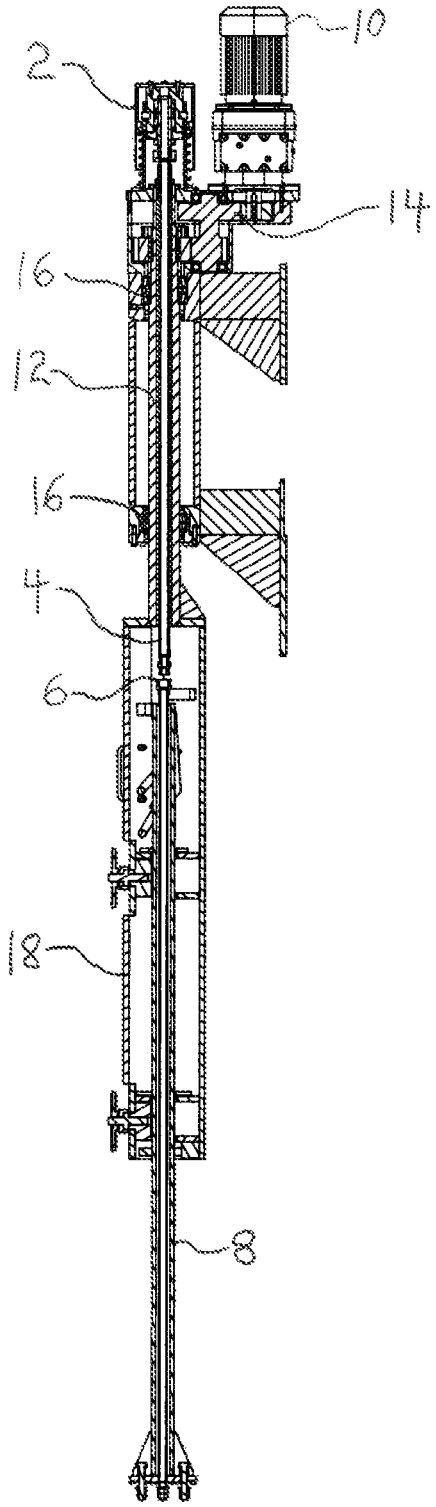
FIG. 2 PRIOR ART
FIG. 2 is a sectional view of applicant's existing rotary lance drive and the upper lance portion shown in FIG. 1.
Figure 3:
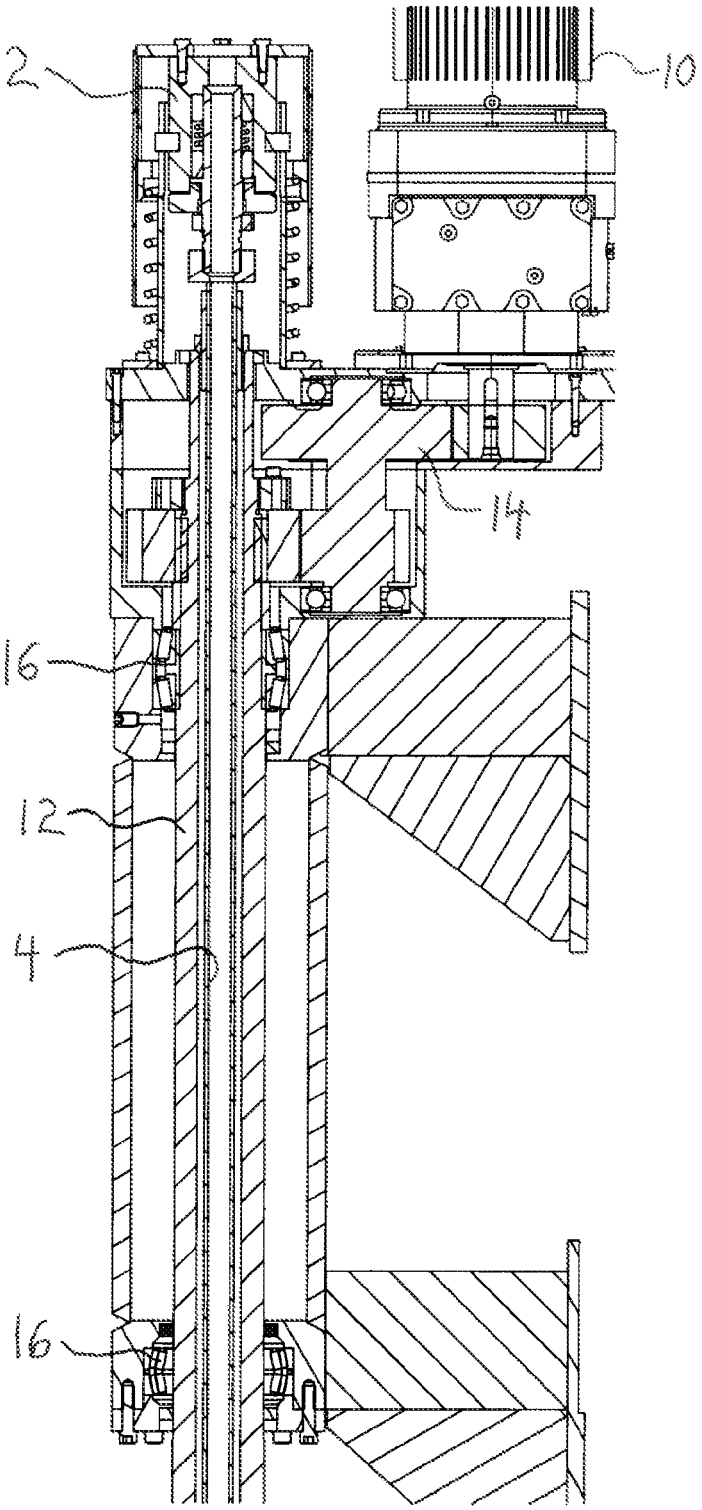
FIG. 3 PRIOR ART
FIG. 3 is a sectional view of a rotary drive mechanism of applicant's existing rotary lance drive.
Figure 4:
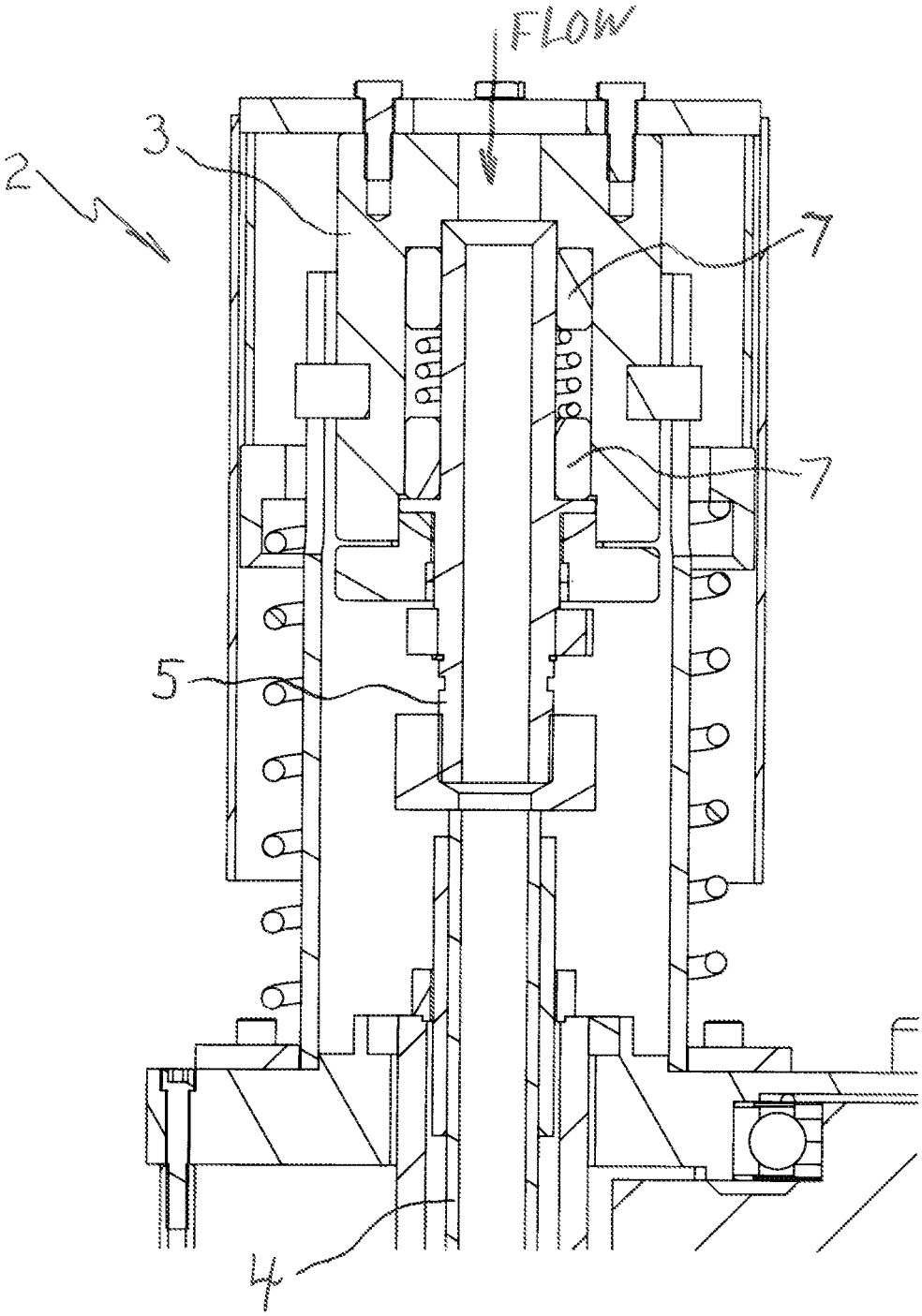
FIG. 4 PRIOR ART
FIG. 4 is a sectional view showing a swivel connection of applicant's existing rotary lance drive.
Figure 5:
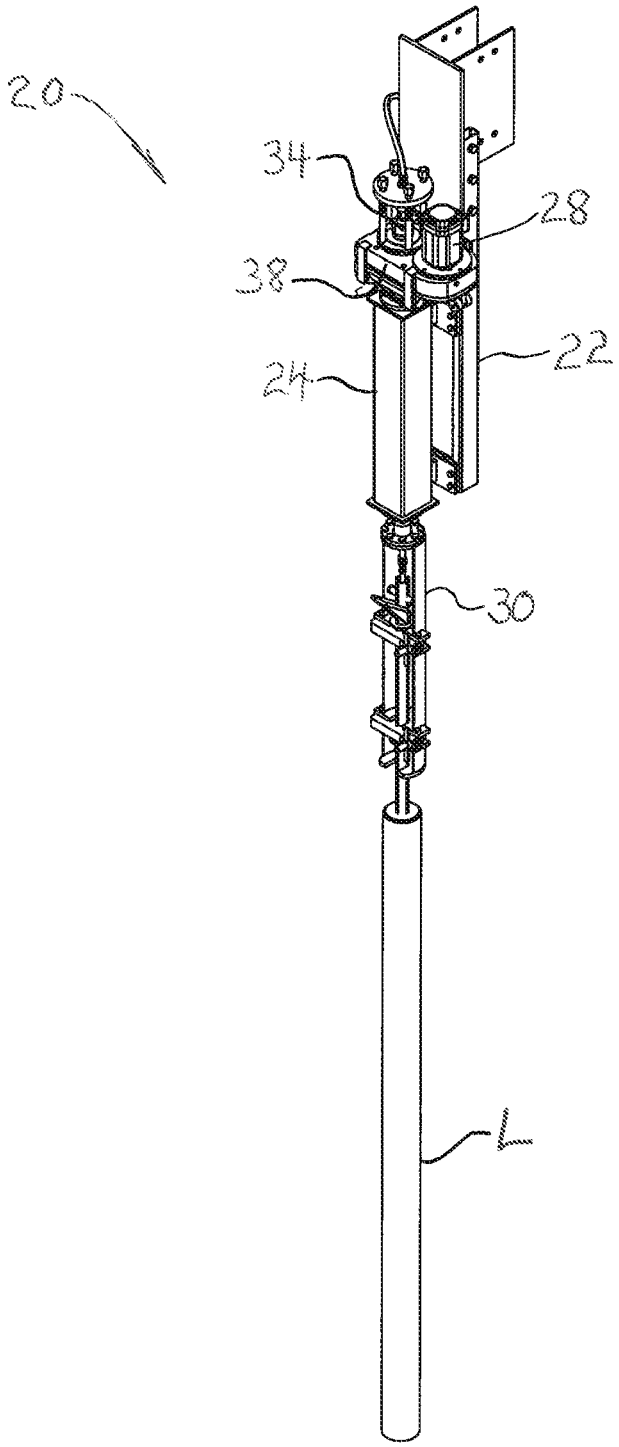
FIG. 5 is a perspective view of a rotary lance drive formed in accordance with a first embodiment of the present invention, shown holding a lance.
Figure 6:
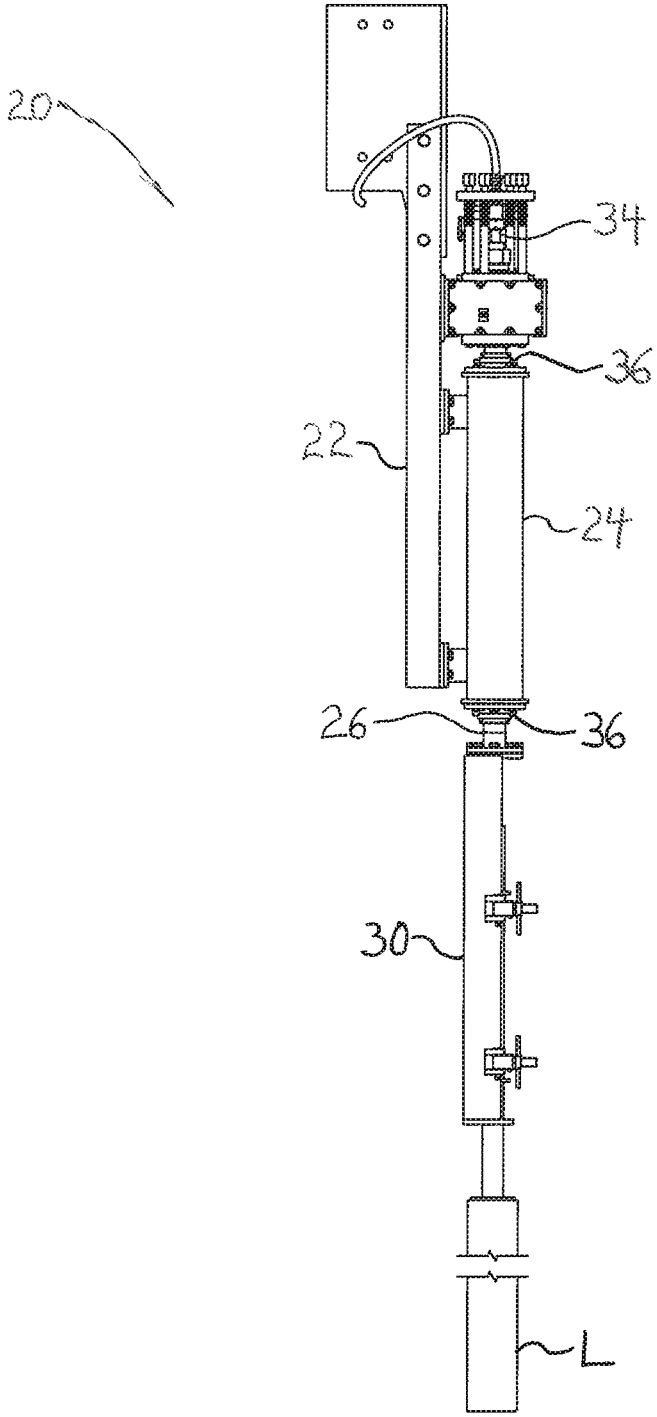
FIG. 6 is a side elevational view of the rotary lance drive and lance shown in FIG. 5.
Figure 7:
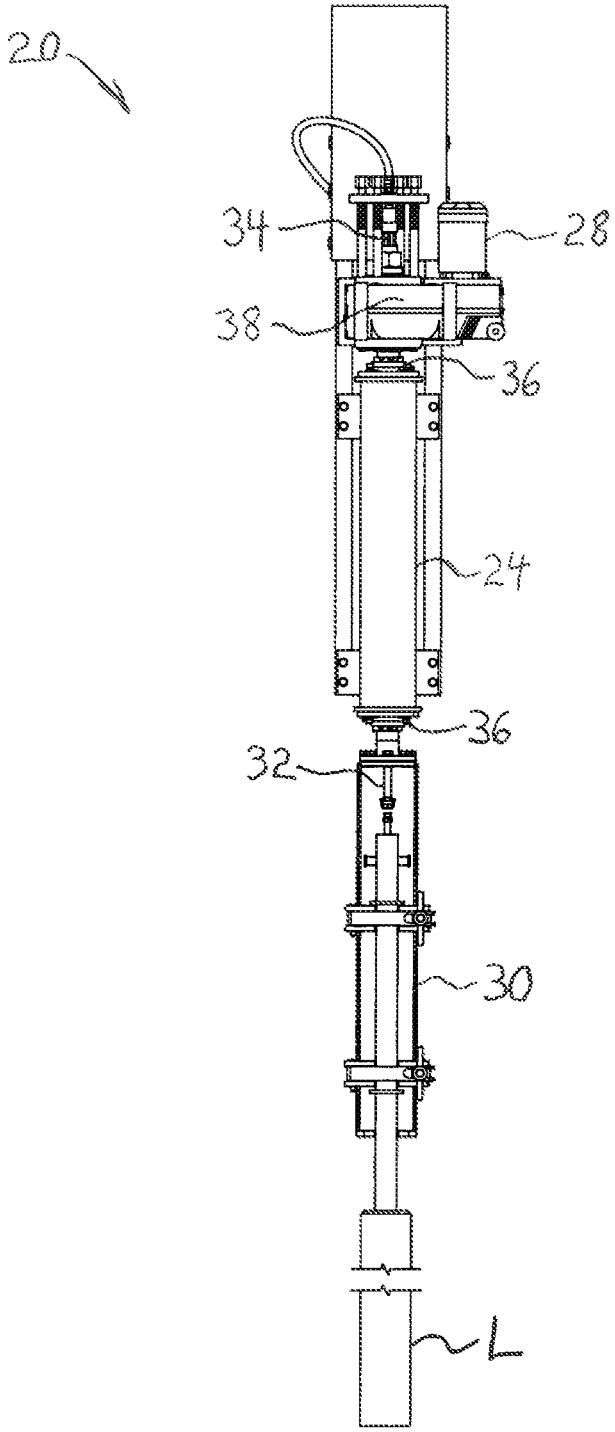
FIG. 7 is a front elevational view of the rotary lance drive and lance shown in FIG. 5.
Figure 8:
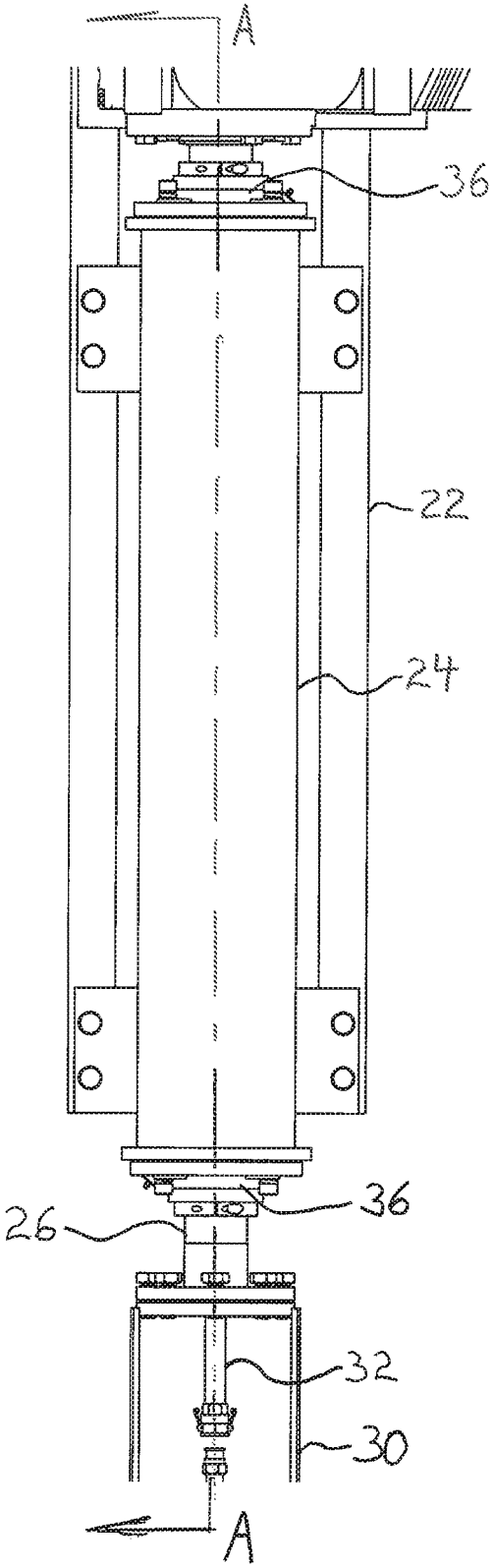
FIG. 8 is a front view showing a support housing and a pair of rotary bearings of the rotary lance drive of FIG. 5.
Figure 9:
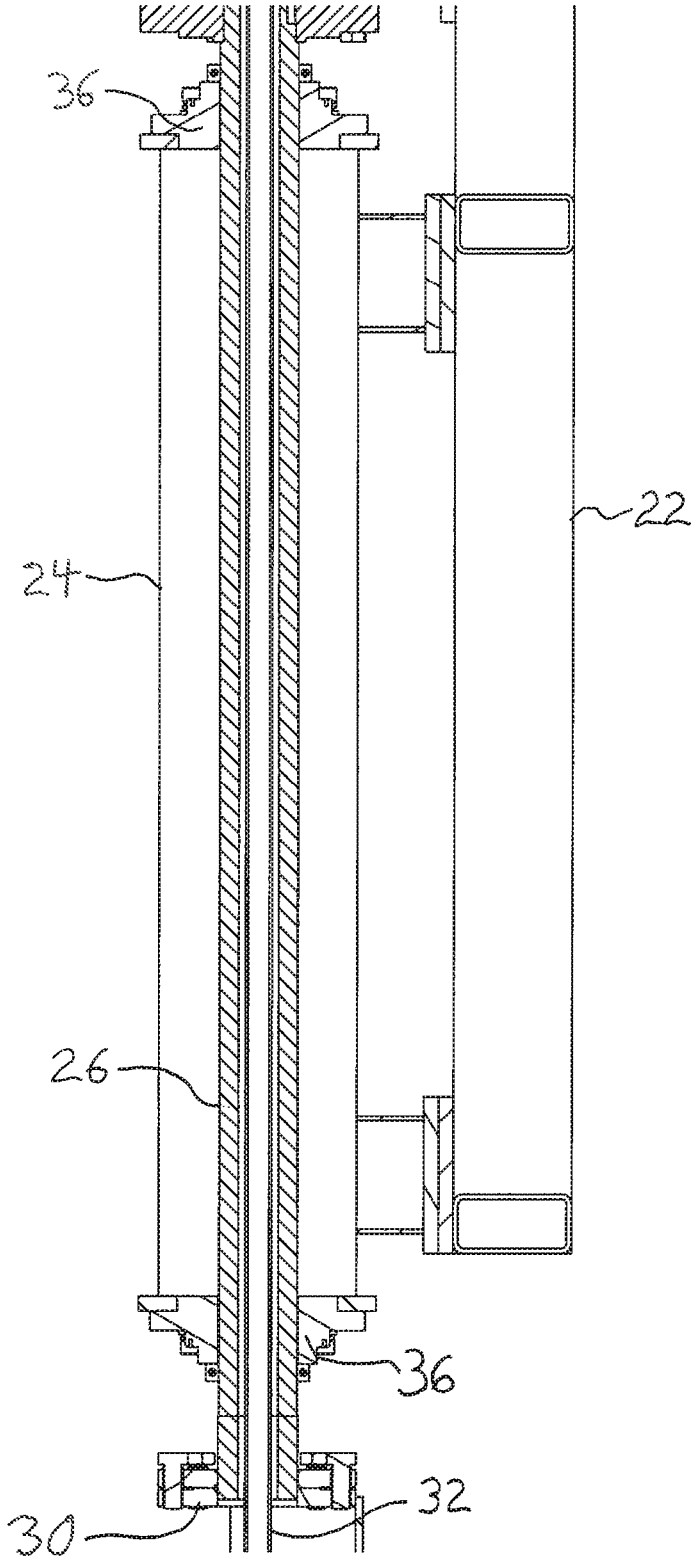
FIG. 9 is a sectional view taken generally along the line A-A in FIG. 8.

FIGS. 5-9 illustrate a rotary lance drive 20 formed in accordance with a first embodiment of the present invention. Lance drive 20 is operable to rotate a lance L about a vertical axis while a gas or powdered reagent is injected into a bath of molten metal through one or more discharge ports in a bottom refractory portion of the lance while the refractory portion is immersed in the molten metal bath.

Rotary lance drive 20 comprises a main support 22 having a support housing 24, a hollow drive shaft 26 extending vertically through support housing 24, a drive motor 28 drivably connected to the hollow drive shaft at a location above an upper end of support housing 24, a lance mount 30 rigidly connected to hollow drive shaft 26, a transport pipe 32 extending vertically through hollow drive shaft 26 into lance mount 30, and a swivel coupling 34 receiving a top end of transport pipe 32.

Hollow drive shaft 26 is supported by a pair of rotary bearings 36 for rotation about a vertical axis of the drive shaft. Rotary bearings 36 may be mounted on support housing 24 and arranged external to support housing 24 adjacent an upper end and a lower end of the support housing, respectively. In contrast to custom-manufactured bearings mounted internally within the support housing, as in applicant's known rotary lance drive described in the Background section above, the present invention uses commercially available, individually-housed rotary bearings that are mounted on the outside of support housing 24. It is preferred that the purchased bearing assembly have an externally accessible lubrication port. A rotary bearing assembly suitable for practicing the present invention is sold by Timken under Part No. E-PF-TRB-3 15/16. The use of externally-mounted "off-the-shelf" bearings saves cost, and simplifies maintenance and replacement of rotary bearings 36.

Drive motor 28 is drivably connected to hollow drive shaft 26 and is operable to rotate the drive shaft about its vertical axis. In the embodiment shown, drive motor 28 is connected to drive shaft 26 by a gear drive 38. As mentioned above, lance mount 30 is rigidly connected to hollow drive shaft 26 and thus rotates with the drive shaft. As a result, lance L held by lance mount 30 is rotated.

Figure 10:
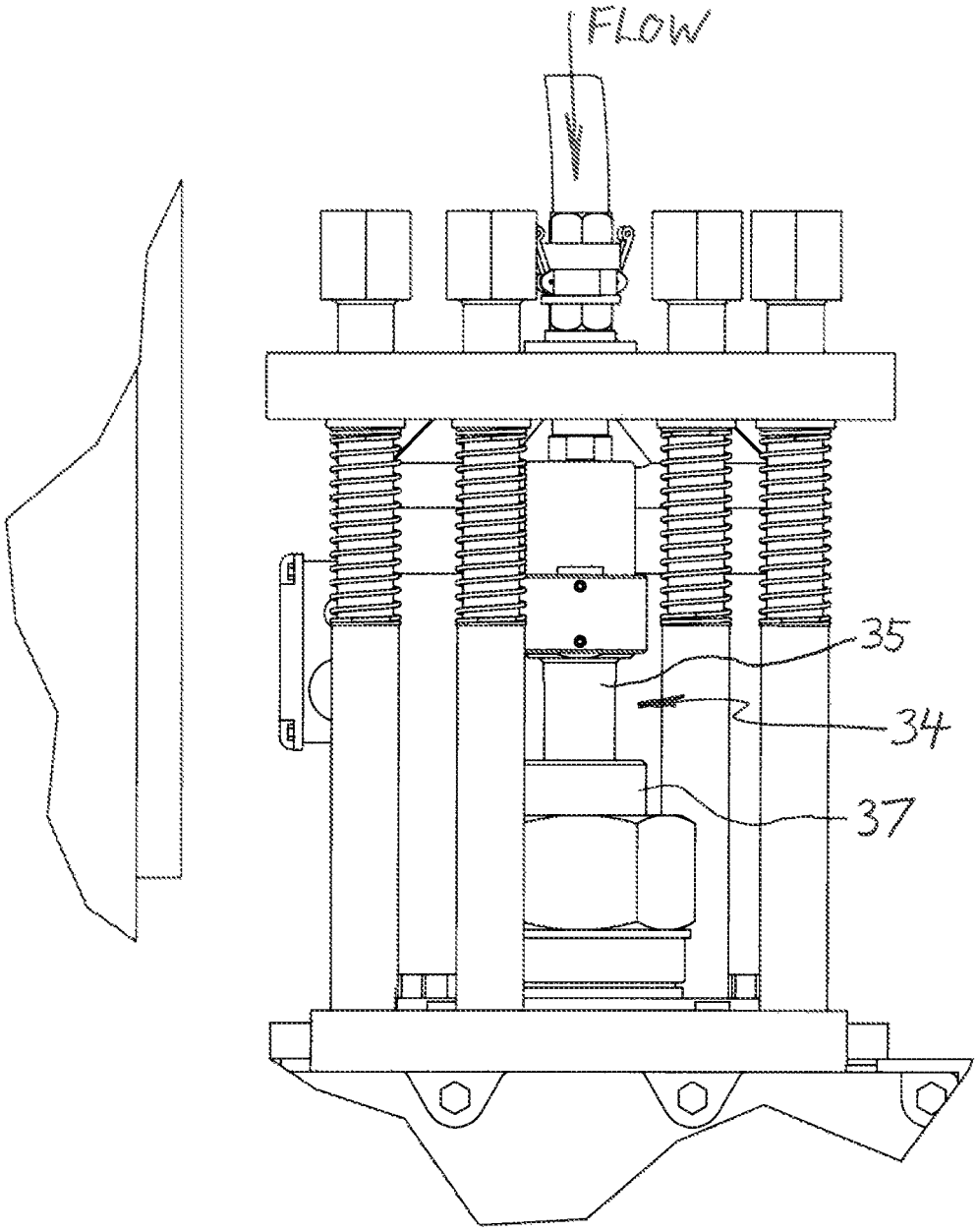
FIG. 10 is a side elevational view of a swivel connection of the rotary lance drive shown in FIG. 5.

Swivel coupling 34, shown in greater detail in FIG. 10, permits connection of a flexible reagent supply hose H to a top end of transport pipe 32 and allows relative rotation between the transport pipe and the connected reagent supply hose. A bottom end of transport pipe 32 is connectable to lance L held by lance mount 30. Swivel coupling 34 prevents supply hose H from twisting when transport pipe 32 rotates with connected lance L. Swivel coupling 34 is similar to swivel connection 2 of applicant's prior art design in that it has an inner coupling part partially extending into a passage of an outer coupling part, wherein a ring-shaped radial space between the overlapping portions of the coupling parts is occupied by bearings and seals for enabling relative rotation between the parts without leakage. In applicant's prior design shown in FIGS. 1-4, the swivel connection 2 was arranged such that reagent was introduced into a radially outer part 3 of the swivel connection and exited a radially inner part 5 of the swivel connection sealed by seals 7 with respect to the outer part 3. In the first embodiment of the present invention, the swivel coupling 34 is inverted such that reagent from supply hose H enters an inner part 35 of swivel coupling 34 and exits an outer part 37 of the swivel coupling. This change intuitively prolongs the life of internal seals and bearings. A commercially available swivel coupling may be used, for example In-Line Swivel No. 006-15111 available from Rotary Systems, Inc. of Minneapolis, Minn.

Figure 11:
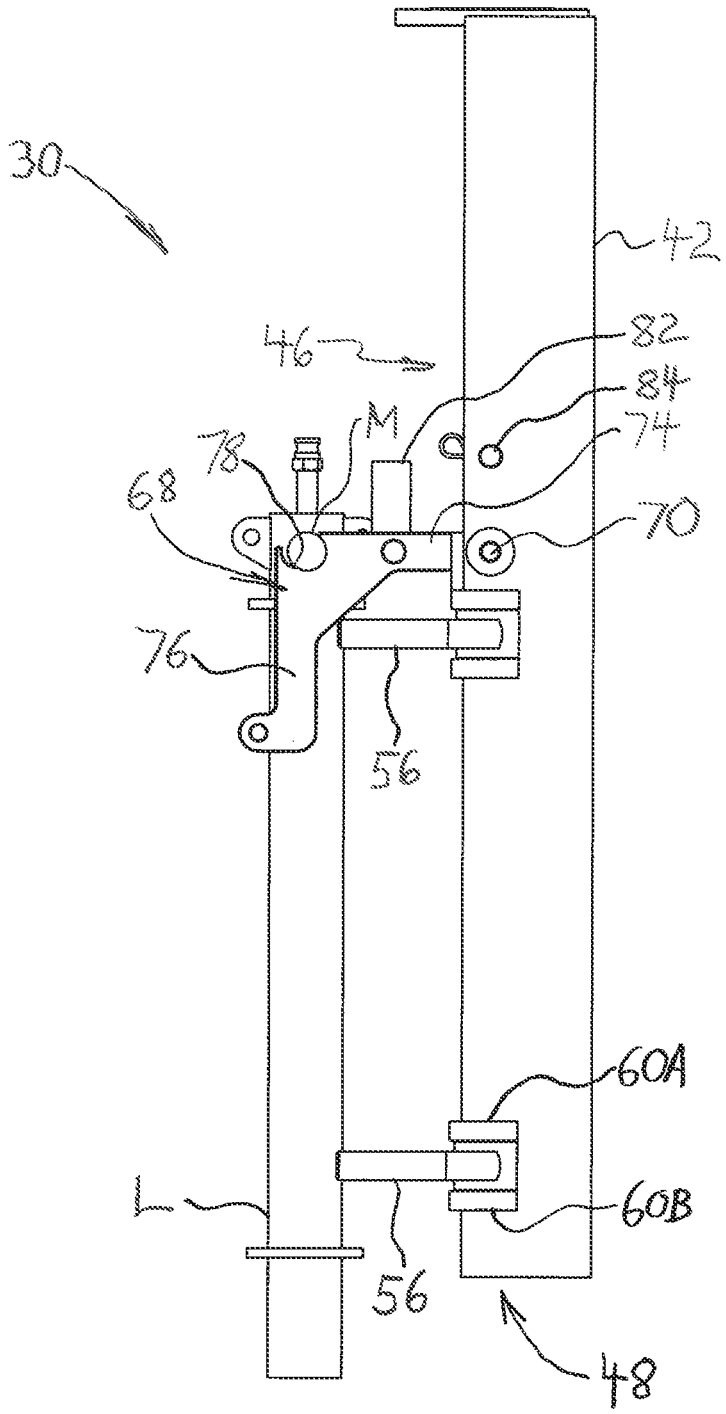
FIG. 11 is a side elevational view of a lance mount of the rotary lance drive shown in FIG. 5, wherein the lance mount is shown in an open position with an upper portion of a lance received for loading.
Figure 12:
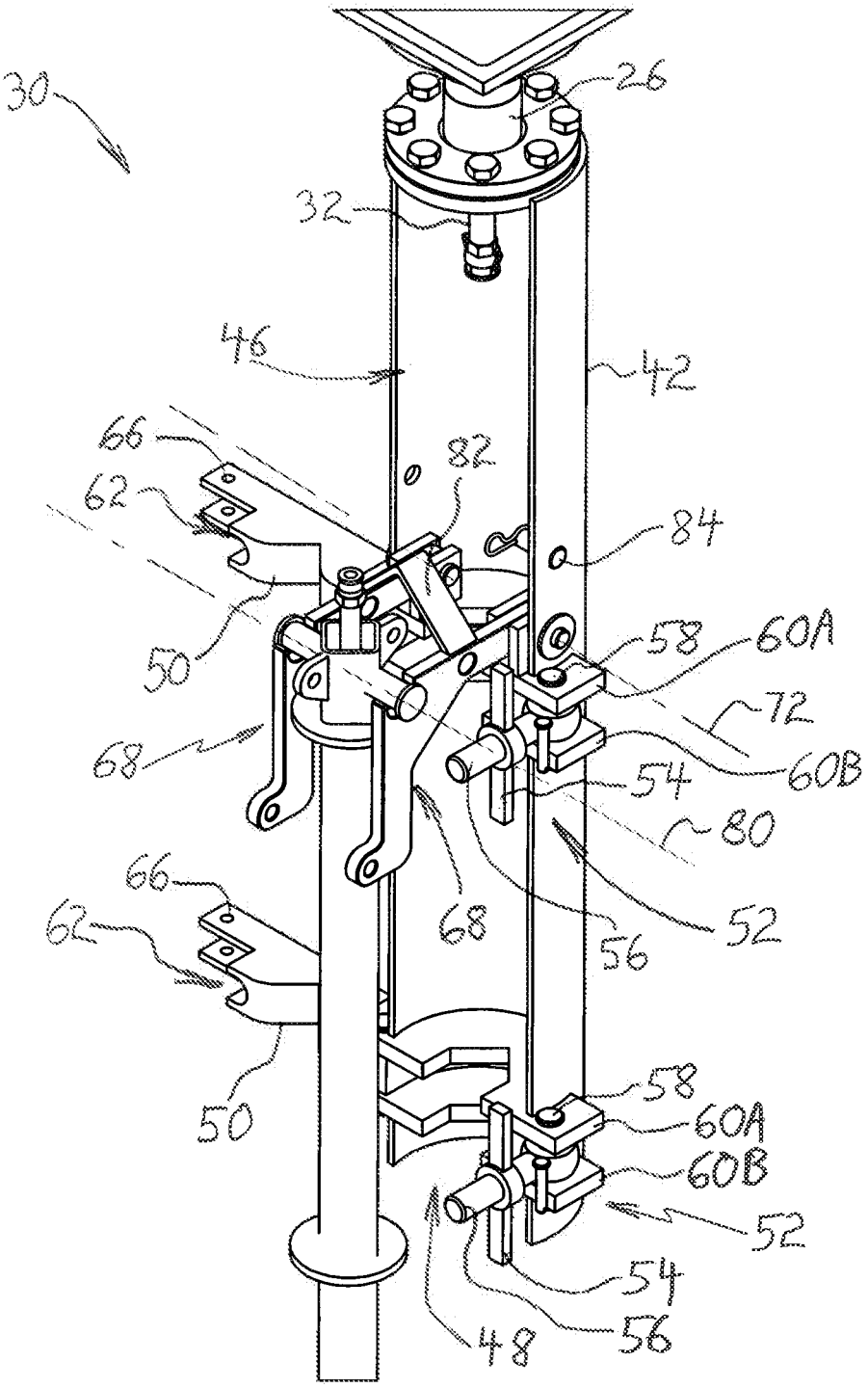
FIG. 12 is a perspective view of the lance mount and upper lance portion shown in FIG. 11.
Figure 13:
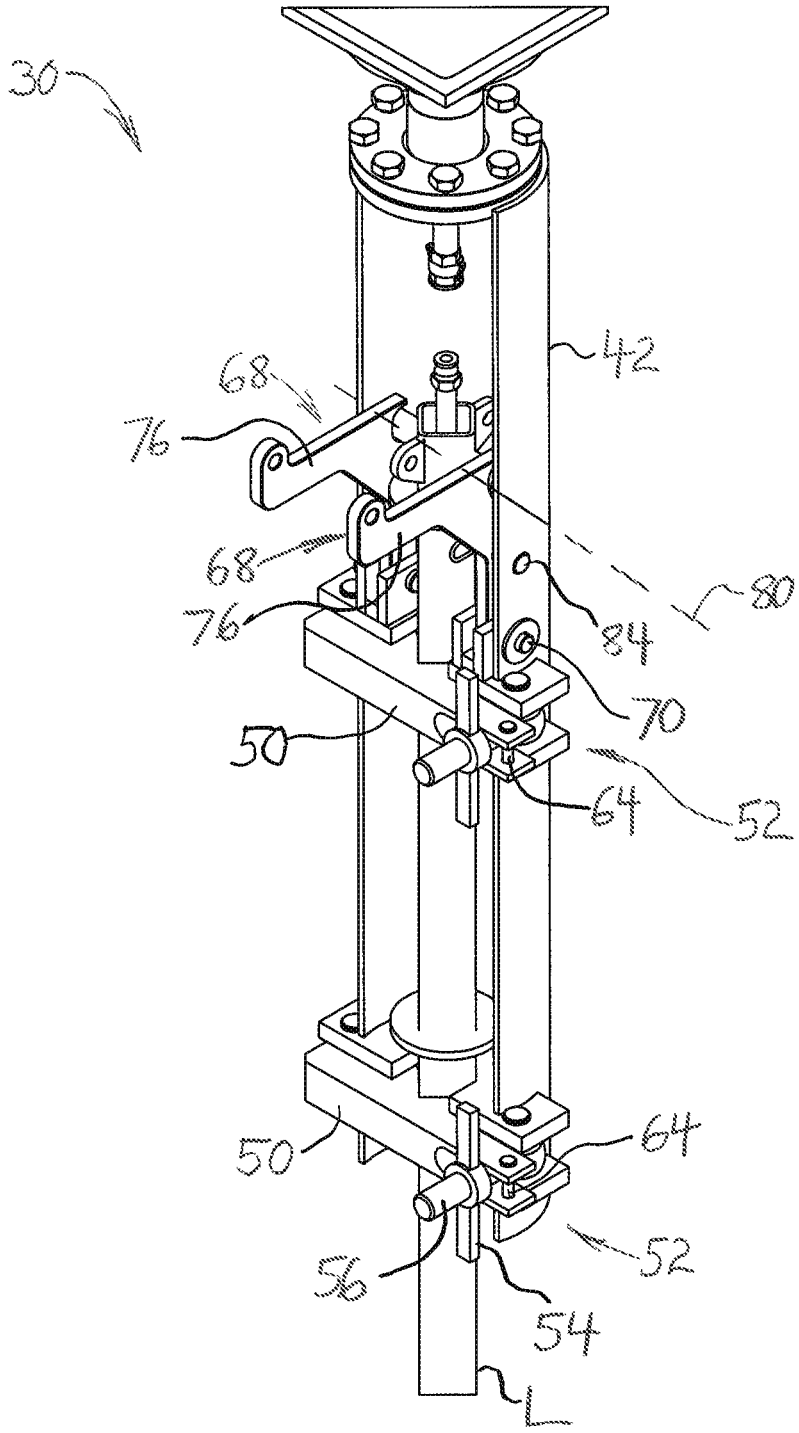
FIG. 13 is a view similar to that of FIG. 12, however showing the lance mount in a closed and locked position holding the upper lance portion.

Lance mount 30 is configured to permit a lance L to be removably held by the lance mount for rotation with the lance mount. A lance mount 30 usable as part of lance drive 20 is depicted in FIGS. 11-13. In the depicted embodiment, lance mount 30 comprises a support sleeve 42 fixable to the lance drive. Support sleeve 42 has an open front 46 and an open bottom 48.

Lance mount 30 also comprises at least one gate member 50 pivotally connected to support sleeve 42 for movement between an open position in which the gate member 50 does not block the open front 46 and a closed position in which the gate member blocks the open front 46. In embodiment shown in FIGS. 11-13, there are two gate members 50, however more or fewer gate members may be provided. Cooperating with each gate member 50 is a corresponding locking mechanism 52 operable to releasably secure the associated gate member 50 gate member in the closed position as shown in FIG. 13. The locking mechanism 52 shown in the drawings includes a wing nut 54 threadably adjustable along a latch stud 56 that is pivotally mounted by a pivot pin 58 between upper and lower plate members 60A and 60B projecting laterally from a side wall of support sleeve 42. Latch stud 56 may be pivoted to extend through a recess 62 in gate member 50, and a removable retainer pin 64 may be inserted through aligned holes 66 in gate member 50 to prevent latch stud 56 from pivoting out of recess 62. Wing nut 54 may be tightened against gate member 50 to secure the gate member in the closed position. Those skilled in the mechanical arts will appreciate that a wide variety of locking mechanisms are available for use, including but not limited to mechanisms employing latches, lock pins, clips, snaps, threaded fasteners, clamps, springs, and combinations of the foregoing. Therefore, the present invention is not limited to the locking mechanism explicitly shown and described herein.

Lance mount 30 further comprises a pair of laterally spaced angle members 68 pivotally connected to support sleeve 42 by pivot pins 70 (only one of two being visible in the drawing figures) for rotation about a transverse pivot axis 72. Each of the pair of angle members 68 has a support leg 74 through which the pivot axis 72 extends, a lever leg 76 extending from the support leg 74, and a loading slot 78 formed in the angle member 68 at a location spaced from pivot axis 72. Each angle member 68 is rotatable about pivot axis 72 between a loading position (see FIGS. 11 and 12) and a locking position (see FIG. 13). The respective loading slots 78 of the pair of angle members 68 are aligned along a transverse slot axis 80 and configured to receive opposite end portions of a cross-member M of an injection lance L. As may be seen, slot axis 80 is forward from the open front 46 of support sleeve 42 when the pair of angle members 68 are in the loading position, and slot axis 80 passes through support sleeve 42 when the pair of angle members 68 are in the locking position.

Angle members 68 may be right angle members wherein lever leg 76 extends from support leg 74 at or approximately at a 90 degree angle relative to the support leg. Loading slot 78 of each angle member 68 may be located at a vertex region of the angle member where legs 74 and 76 intersect. Angle members 68 may be rigidly connected to one another by a brace member 82 such that the angle members pivot about axis 72 in unison. Brace member 82 may be configured to engage an inner surface of support sleeve 42 when the pair of angle members are in the locking position for stability in supporting lance L within the support sleeve. In order to hold angle members in the locking position shown in FIG. 13 while gate members 50 are being locked, lance mount 30 may include at least one removable locking pin 84 insertable through aligned holes in the support sleeve 42 and a support leg 74 of one of the angle members. As may be understood from FIGS. 12 and 13, when lance mount 30 is in its open position and angle members 68 are pivoted down into their loading position, lance L may be suspended within slots 78. To secure the lance, angle members 68 are pivoted upward into their locking position to move the upper portion of lance L through open front 46 into support sleeve 42, and locking pin 84 is inserted to retain the angle members 68 in the locking position. Gate members 50 may then be closed and locked.

Figure 14:
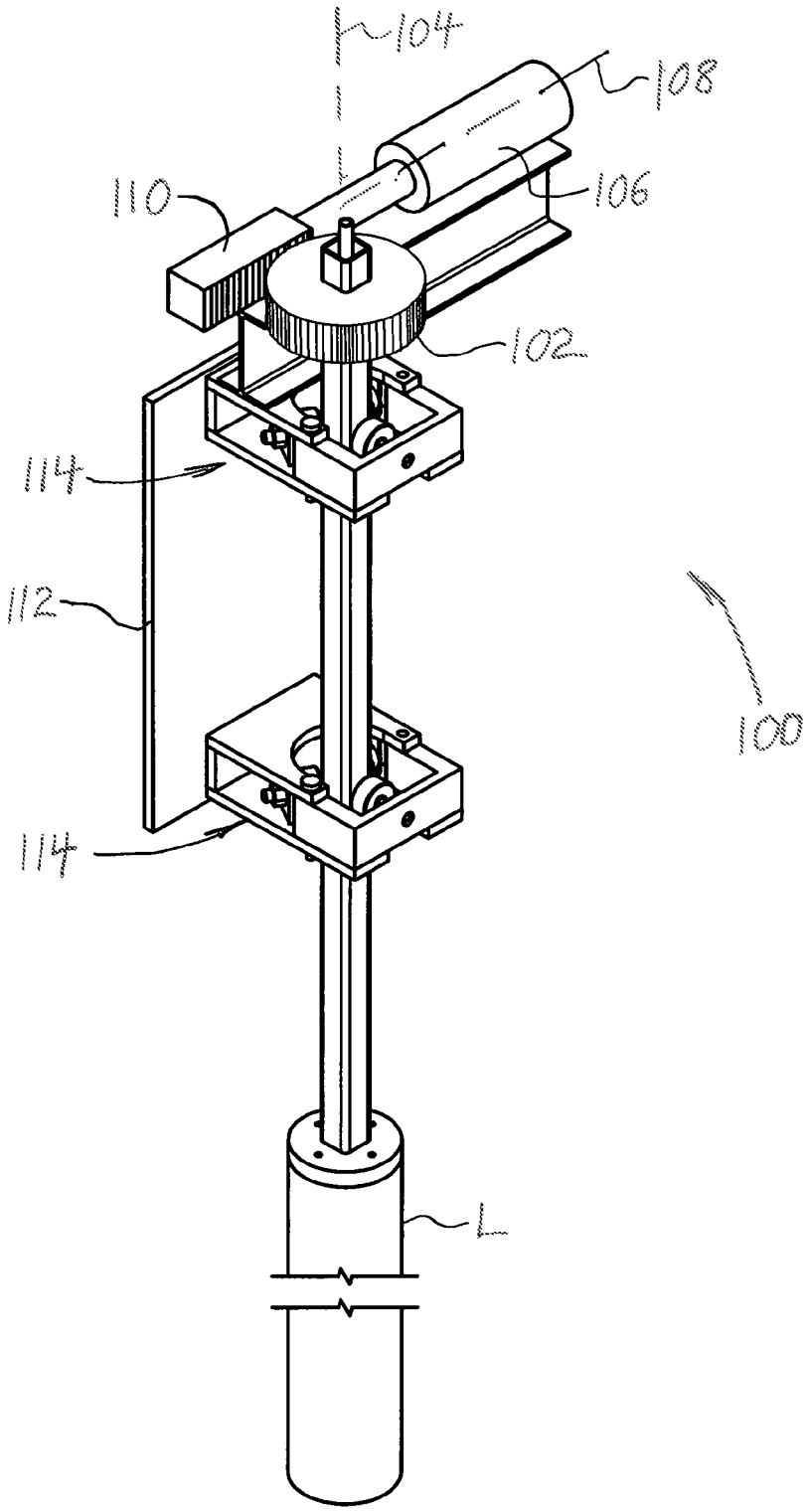
FIG. 14 is a perspective view of a reciprocating rotary lance drive formed in accordance with a second embodiment of the present invention, shown holding a lance.

Reference is now made to FIG. 14 for description of a reciprocating rotary lance drive 100 formed in accordance with a second embodiment of the present invention. Lance drive 100 comprises a rotary element 102 rotatable about a rotational axis 104. Rotary element 102 is configured for connection to an upper portion of a lance L such that rotation of rotary element 102 is imparted to the lance. Lance drive 100 also comprises a linear actuator 106 having a stroke axis 108 and a stroke length, and a transmission element 110 displaced by linear actuator 106. Transmission element 110 is connected to rotary element 102 such that linear motion of linear actuator 106 along stroke axis 108 is converted to rotational motion of rotary element 102 about rotational axis 104. While transmission element 110 may take any form, including a multi-bar pivotal linkage, a simple configuration is to use a toothed rack as transmission element 110 meshed with a pinion gear as rotary element 102 in accordance with the illustration of FIG. 14.

As may be understood, successive extension and retraction of linear actuator 106 along stroke axis 108 causes reciprocating rotational motion of the lance L in opposite rotational directions. In accordance with the present invention, the stroke length of linear actuator 106 is chosen such that the linear actuator causes a rotation of lance L that is less than 360 degrees in a given rotational direction. By way of non-limiting example, the stroke length may be chosen such that linear actuator 106 causes a rotation of the lance that is approximately 90 degrees in a given rotational direction.

Lance drive 100 may further comprise a main support 112 for removably receiving the upper portion of lance L. Main support 112 includes a pair of rotary support bearings 114 for rotatably receiving the upper portion of the lance. Rotary bearings 114 may be incorporated into a clamping lance mount mechanism to significantly reduce the size of the entire lance drive 100 relative to lance drive 20 of the first embodiment and relative to rotary lance drives of the prior art. Having a smaller reciprocating lance drive simplifies the task of converting fixed lance drives in the field to rotary lance drives.

The reciprocating lance drive 100 of the second embodiment eliminates the need for a swivel connection at the top of the lance drive because the lance does not continuously rotate in one rotational direction. Moreover, the hollow drive shaft and reagent pipe running through the middle of the drive shaft are also eliminated, which removes a source for leaks and reduces the number of items that require maintenance. Generally, the rack-and-pinion drive is less expensive and complex than a motor and gear drive used by continuous rotary lance drives. The reciprocating lance drive offers the benefits of a larger reaction zone while keeping the drive mechanism simple.

The provision of reciprocating rotary action according to the present invention is not limited to the particular drive mechanism configuration shown in FIG. 14. As will be understood, a configuration using a rotary actuator, such as lance drive 20 using drive motor 28, is capable of being controlled so as to provide reciprocating rotary motion in opposite rotational directions instead of continuous rotary motion in one rotational direction. Accordingly, the invention encompasses a method of injecting a reagent into a bath of molten metal comprising the steps of immersing a portion of an injection lance into the molten metal, rotating the lance about a longitudinal axis thereof in a first rotational direction through a first angle less than 360 degrees, rotating the lance about the longitudinal axis in a second rotational direction opposite the first rotational direction through a second angle less than or equal to the first angle in magnitude, and discharging reagent through at least one reagent port of the lance while the lance is rotating.

Figure 15:
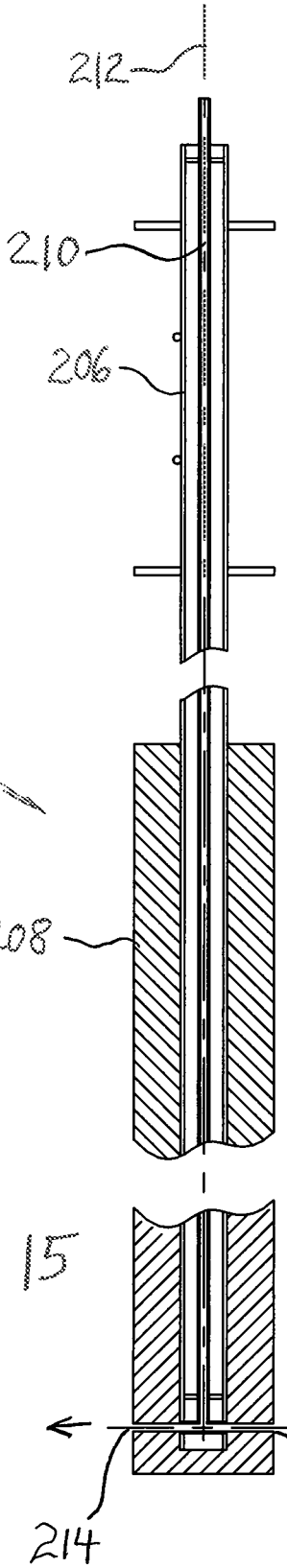
FIG. 15 is a sectional view of a hexagonal lance formed in accordance with an embodiment of the present invention.
Figure 16:
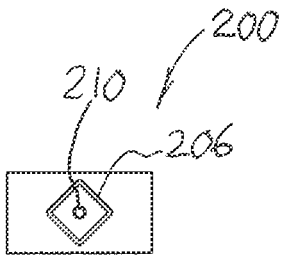
FIG. 16 is a top view of the lance shown in FIG. 15.
Figure 17:
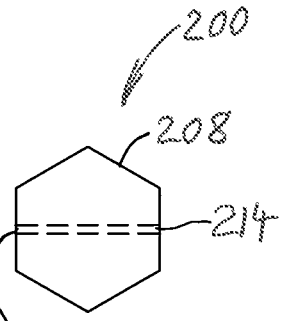
FIG. 17 is a bottom view of the lance shown in FIG. 15.
Figures 18, 19, 20:
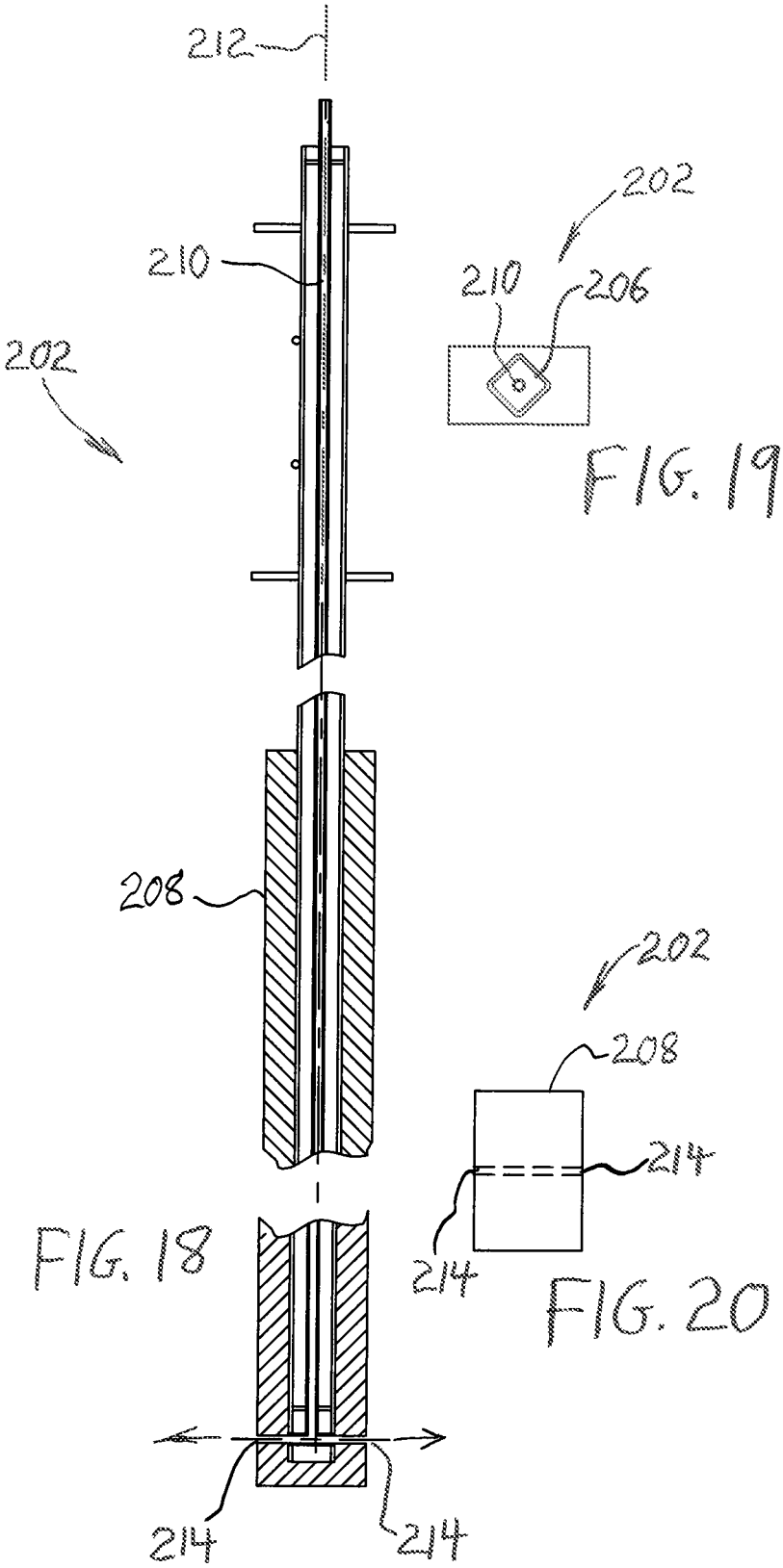
FIG. 18 is a sectional view of a rectangular lance formed in accordance with another embodiment of the present invention.
FIG. 19 is a top view of the lance shown in FIG. 18.
FIG. 20 is a bottom view of the lance shown in FIG. 18.
Figures 21, 22, 23:
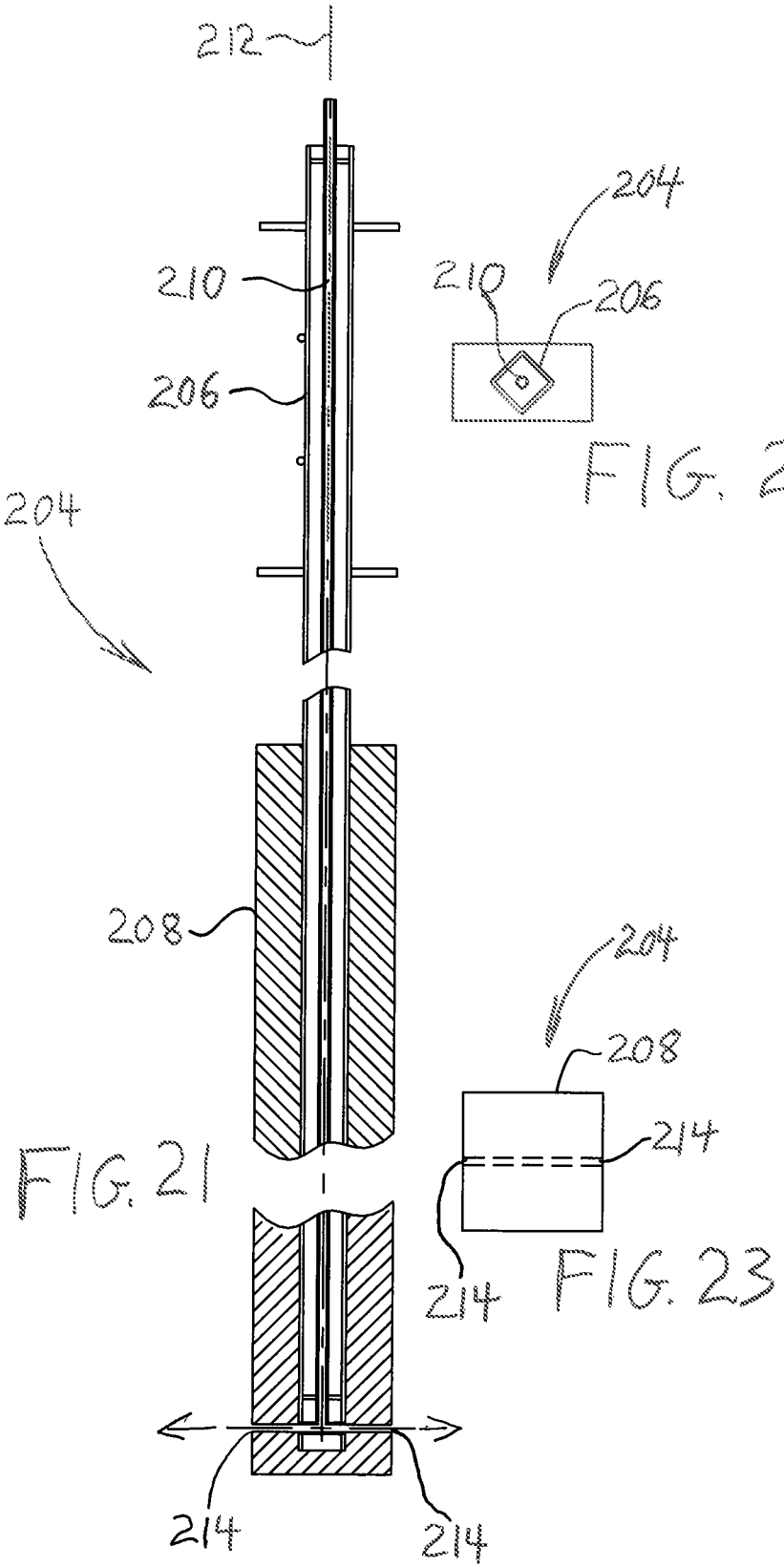
FIG. 21 is a sectional view of a square lance formed in accordance with another embodiment of the present invention.
FIG. 22 is a top view of the lance shown in FIG. 21.
FIG. 23 is a bottom view of the lance shown in FIG. 21.

The present invention extends to various lances that may be used with lance drives 10 and 100, or with any lance drive. FIGS. 15-23 illustrate lances wherein an immersable refractory portion has a non-circular cross-sectional shape effective to stir or agitate the molten metal by rotation of the lance about a rotational axis extending through the non-refractory portion, as would be provided by a rotary lance drive. FIGS. 15-17 show a hexagonal lance 200, FIGS. 18-20 show a rectangular lance 202, and FIGS. 21-23 show a square lance 204. Lances 200, 202, and 204 are similar in that each includes an upper non-refractory portion 206 defining a top end of the lance and a lower refractory portion 208 defining a bottom end of the lance. The lower refractory portion 208 of each lance has a coating of refractory material and a non-circular cross-sectional shape. Lances 200, 202, and 204 are further similar in that each has a main conduit 210 extending along a conduit axis 212 from the top end of the lance through upper non-refractory portion 206 and into lower refractory portion 208. The lower refractory portion 208 of each lance has at least one discharge port 214 in flow communication with main conduit 210 so as to define a corresponding discharge direction divergent from conduit axis 212. The depicted lance embodiments are in the form of "Tee" lances in which two discharge ports 214 are provided facing in discharge directions that are 180 degrees opposite from one another, wherein the discharge directions are perpendicular to conduit axis 212. Lances 200, 202, and 204 may be rotated about a rotational axis that is coincident with conduit axis 212. Alternatively, lances 200, 202, and 204 may be configured such that they rotate about a rotational axis that is offset from conduit axis 212 or that is otherwise non-coincident with conduit axis 212.

Figures 24, 25, 26:
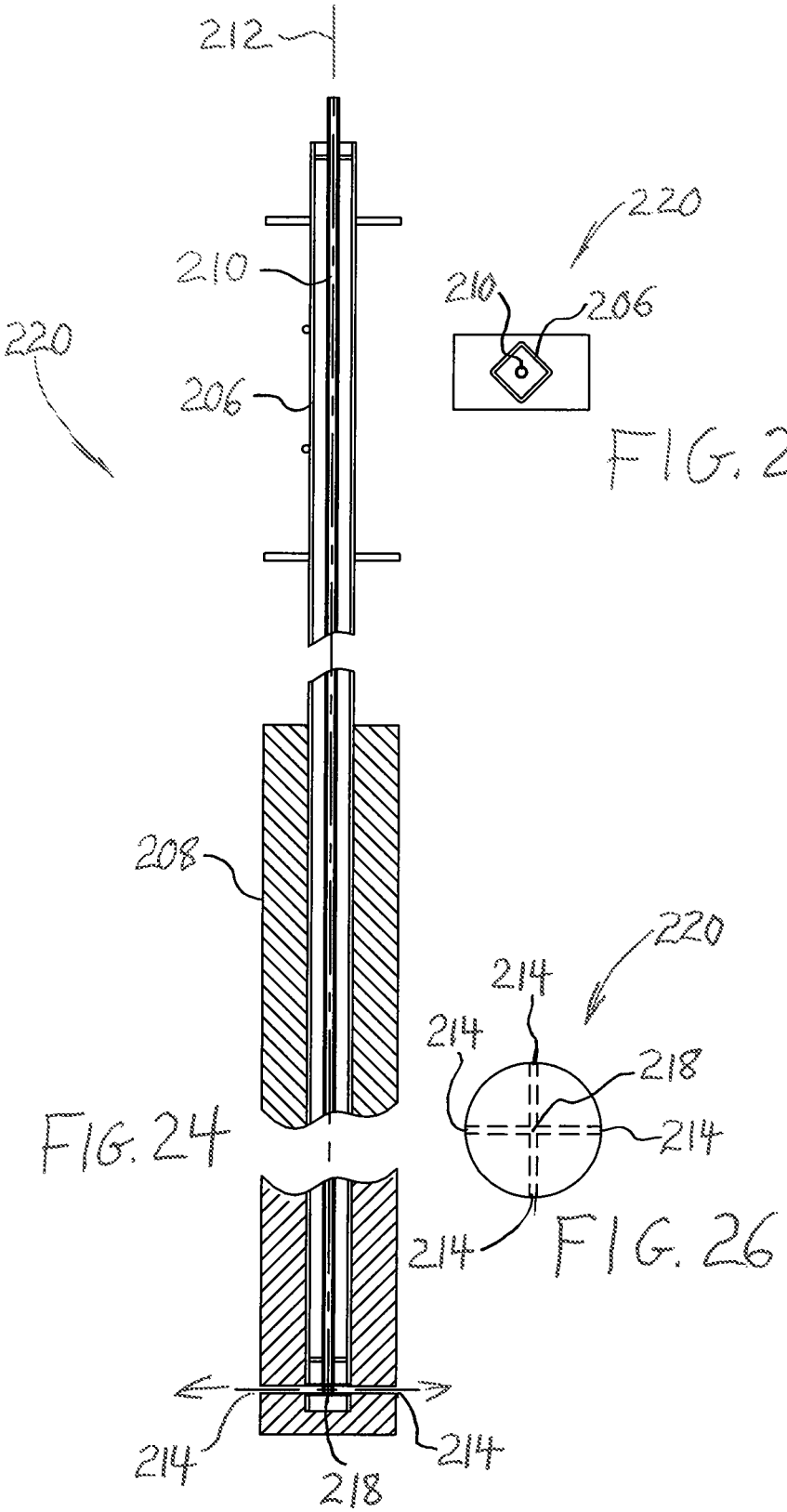
FIG. 24 is a sectional view of a cross-port lance formed in accordance with another embodiment of the present invention.
FIG. 25 is a top view of the lance shown in FIG. 24.
FIG. 26 is a bottom view of the lance shown in FIG. 24.

FIGS. 24-26 illustrate a cross-port lance 220 formed in accordance with another embodiment of the present invention. Lance 220 is similar to lances 200, 202, and 204 described above in that lance 220 comprises an upper non-refractory portion 206 defining a top end of the lance, a lower refractory portion 208 coated with refractory material and defining a bottom end of the lance, and a main conduit 210 extending along a conduit axis 212 from the top end of the lance through upper non-refractory portion 206 and into the lower refractory portion 208. Lance 220 is characterized by a the fact that lower refractory portion 208 has four discharge ports 214 in flow communication with main conduit 210 so as to define four different corresponding discharge directions divergent from conduit axis 212. The four discharge ports 214 may be in flow communication with main conduit 210 by a plurality of discharge conduits 216 intersecting with one another and with main conduit 210 at a single location 218. The four discharge directions may be angularly spaced about conduit axis 212 by regular 90 degree intervals. Alternatively, irregular angular spacing may be provided. While four discharge ports are shown, more discharge ports may be provided. Refractory portion 208 may have a circular cross section as shown in FIG. 26, or it may have a non-circular cross-sectional shape effective to stir the molten metal during rotation as described above for lances 200, 202, and 204.

FIGS. 27-29 illustrate a cross dual-port lance 230 formed in accordance with a further embodiment of the present invention. Like the other lance embodiments described above, lance 230 includes an upper non-refractory portion 206 defining a top end of the lance and a lower refractory portion 208 coated with refractory material and defining a bottom end of the lance. However, instead of a single main conduit 210, lance 230 has first and second main conduits 210A and 210B extending along respective conduit axes 212A and 212B from the top end of the lance through upper non-refractory portion 206 and into lower refractory portion 208. Lower refractory portion 208 has a first pair of discharge ports 214A in flow communication with the first main conduit 210A so as to define a first pair of corresponding discharge directions divergent from first conduit axis 210A. Lower refractory portion 208 also has a second pair of discharge ports 214B in flow communication with the second main conduit 210B so as to define a second pair of corresponding discharge directions divergent from second conduit axis 212B and divergent from the first pair of discharge directions. Thus, two independent conduits allow twice as much gas or powdered reagent to be injected within a given time period as compared to single-conduit lances, and allow for the possibility of injecting a different reagent or gas through each conduit. In the depicted embodiment the second conduit axis 212B is parallel to the first conduit axis 212A, but a non-parallel arrangement could be used. The first pair of discharge directions may be 180 degrees opposite one another about the first conduit axis. Likewise, the second pair of discharge directions may be 180 degrees opposite one another about the second conduit axis. The four discharge directions may be angularly spaced by 90 degree intervals as shown in FIG. 29, or another angular spacing may be chosen. Refractory portion 208 of lance 230 may have a circular cross section as shown in FIG. 29, or it may have a non-circular cross-sectional shape effective to stir the molten metal during rotation as described above for lances 200, 202, and 204.

The lances described above improve efficiency by reducing process time. Powdered reagents are distributed to as much of the molten bath as possible to enable more reactions between the reagent and the molten metal. By changing the cross-sectional shape of the refractory portion of the lance to a shape that has corners, the rotation of the lance generates additional mixing because the edges and corners of the refractory portion act as a mixing paddle, stirring the molten bath and thereby improving efficiency. Efficiency is also improved by increasing the number of discharge ports from two (Tee lance) to four or more. With a cross-port lance, the number of reaction zones doubles relative a Tee lance. The cross dual-port lance described above doubles the reagent feed rate and, if used with a rotary lance drive, provides increased reaction zones with minimal treatment times.

Embodiments of the present invention are described in detail herein, however those skilled in the art will realize that modifications may be made. Such modifications do not stray from the spirit and scope of the invention as defined by the appended claims.

What is claimed is:

1. A rotary lance drive for rotating a lance for injecting gas and powdered reagents into molten metal, the rotary lance drive comprising:

a main support having a support housing and a pair of rotary bearings arranged external to the support housing respectively adjacent an upper end and a lower end of the support housing;

a hollow shaft extending vertically through the support housing and supported by the pair of rotary bearings for rotation about a vertical axis;

a drive motor drivably connected to the hollow shaft, the drive motor being operable to rotate the hollow shaft about the vertical axis;

a lance mount rigidly connected to the hollow shaft for rotation with the hollow shaft, the lance mount being configured to permit a lance to be removably held by the lance mount for rotation with the lance mount;

a transport pipe extending vertically through the hollow shaft into the lance mount, a bottom end of the transport pipe being connectable to a lance held by the lance mount; and a swivel coupling receiving a top end of the transport pipe, the swivel coupling permitting connection of a flexible reagent supply hose to the transport pipe and allowing relative rotation between the transport pipe and the supply hose;

wherein the swivel coupling includes an inner part partially extending into an outer part, wherein the swivel coupling is arranged such that reagent from the supply hose enters the swivel coupling through the inner part and exits the swivel coupling through the outer part.

2. The lance drive according to claim 1, wherein the drive motor is drivably connected to the hollow shaft at a location above the upper end of the support housing.

* * * * *